US005825275A

United States Patent [19]

Wuttig et al.

[11] Patent Number: 5,825,275

[45] Date of Patent: Oct. 20, 1998

[54] COMPOSITE SHAPE MEMORY MICRO ACTUATOR

[75] Inventors: Manfred Wuttig, Silver Spring; Quanmin Su, Greenbelt, both of Md.

[73] Assignee: University of Maryland, College Park, Md.

[21] Appl. No.: 735,646

[22] Filed: Oct. 25, 1996

Related U.S. Application Data

[60] Provisional application No. 60/005,902 Oct. 27, 1995.

[51] Int. Cl.[6] ..... H01H 37/46; H01H 37/48

[52] U.S. Cl. ..... 337/139; 148/402; 337/140

[58] Field of Search ..... 337/140; 251/129.02; 148/402, 563

[56] References Cited

U.S. PATENT DOCUMENTS

| | | | |
|---|---|---|---|
| 4,639,060 | 1/1987 | Lionnet | 339/30 |
| 4,864,824 | 9/1989 | Gabriel | 60/527 |
| 5,061,914 | 10/1991 | Busch | 337/140 |
| 5,226,979 | 7/1993 | Thoma . | |
| 5,309,717 | 5/1994 | Minch . | |
| 5,344,117 | 9/1994 | Trah et al. . | |

OTHER PUBLICATIONS

"A Practical Microgripper by fine alignment, eutectic bonding and SMA actuation", Lee et al, *Sensors and Actuators A,* 54, Elsevier Science S.A., 1996, pp. 755–759.

"The Two–Way Effect in Homogeneous Alloys and Composites for Robotic Applications", Escher et al, *Proceedings of the International Conference on Martensitic Transformations,* 1992, Monterey Institute for Advanced Studies, Monterey, CA, USA, pp. 1289–1294.

"Thin Film Shape Memory Alloy Microactuators", Krulevitch et al, *Journal of Microelectromechanical Systems,* vol. 5, No. 4, Dec. 1996, pp. 270–282.

*Primary Examiner*—Leo P. Picard
*Assistant Examiner*—Anatoly Vortman
*Attorney, Agent, or Firm*—Nikaido, Marmelstein, Murray & Oram LLP

[57] ABSTRACT

A micro-dimensioned shape memory alloy composite composed of a thin film of shape memory material and a substrate film. The substrate film does not require further processing and thus the composite can be used as a switch without removing any portion of the substrate on which the SMA is deposited. It is also shown that more effective switches can be manufactured by including as a component of the composite a stress compensating film.

15 Claims, 3 Drawing Sheets

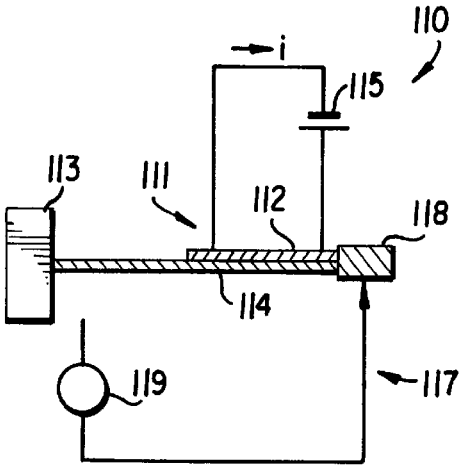
FIG. 1a
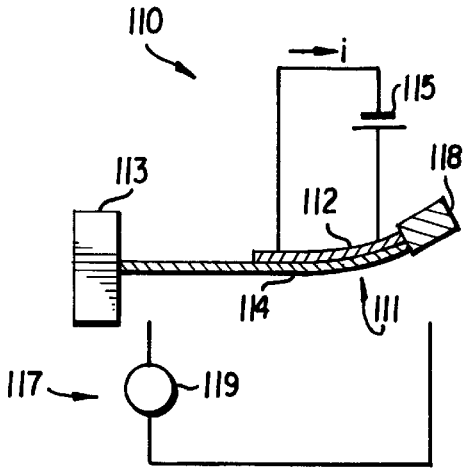
FIG. 1b
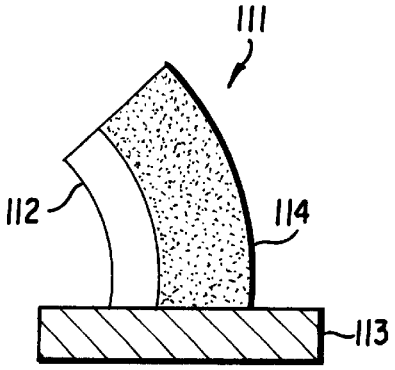
FIG. 2a
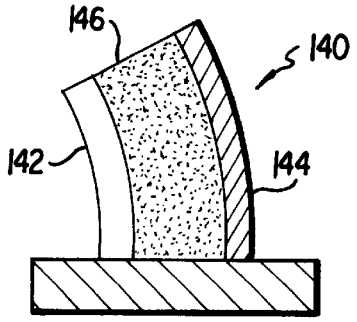
FIG. 2b
FIG. 2c
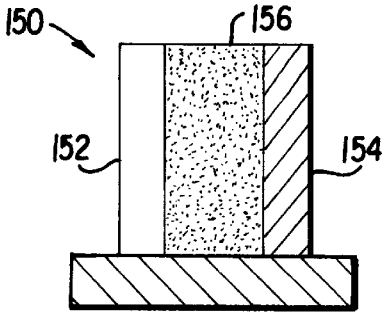

COMPOSITE SHAPE MEMORY MICRO ACTUATOR

RELATED APPLICATION

This application is a non-provisional application claiming benefit of provisional application 60/005,902, filed Oct. 27, 1995, which is herein incorporated by reference.

1. Field of the Invention

The present invention relates to shape memory actuators and specifically to multimorph actuators of micro dimensions.

2. Background of the Invention

It is known to use shape-memory alloys in actuators. Such actuators generally operate on the principle of deforming the shape-memory alloy (for convenience herein sometimes referred to as just "alloy" or "SMA") while it is below its phase transformation temperature and then heating it above its transformation temperature range to recover all or part of the deformation, and in the process move or cause to move one or more mechanical elements.

A bi-morph actuator is disclosed by Escher et al, The Two-way Effect in Homogenous and Composites in Robotic applications. Proceedings of the International Conference on Martensitic Transformations (1992) Monterey, Calif. pp 1289–1294 (herein incorporated by reference). Escher et al disclose the production of macro size actuators as gripping elements wherein an NiTi SMA is coated with wax and then encapsulated with silicone creating finger elements for robots. Actuation of the fingers is accomplished by directly heating the SMA and cooling the composite with a fluid such as water or air by directing the fluid through-channels produced by melting and removing the wax prior to robotic assembly.

Applying direct heat to SMA actuators will deform the actuator, and this is a simple matter. If a faster response is desired, such a result is achieved by merely applying additional electric power to the SMA; however, as alluded to above, SMAs are slow to cool and in order to obtain a fast recovery, macro SMA actuators, as discussed above, require active cooling means, i.e., additional structure which increases the bulk of such actuators and of course their fabrication expense.

These technical disadvantages can be overcome by constructing micro thin-film actuators.

Such actuators dissipate heat quickly. Thin film, or micro-actuators of SMA will also exhibit the following advantages: i) such SMA will exert stresses of hundreds of mega-pascals; ii) such SMA tolerate strains of greater than 3%; iii) they work at common TTL voltages; iv) they can be directly powered with electrical leads on a chip; and v) they survive millions of cycles without fatigue.

The production of such thin film actuators is disclosed in U.S. Pat. No. 5,061,914 (herein incorporated by reference); however, these films were used to create actuators requiring the etching of substrates. Although these films dissipate heat quickly, actuator production requires process steps that include removing at least a portion of the substrate.

Thus, an object of the present invention is to overcome the deficiencies of the prior art.

Another object of the present invention is to improve the cooling rate of micro-actuators.

Another object of the invention relates to producing an actuator comprising a thin film of SMA and an intact substrate.

Another object of the invention is to simplify the manufacturing process for making thin-film actuators.

Still, another object of the invention is to create multimorph thin-film actuators having improved switching capabilities.

SUMMARY OF THE INVENTION

The present invention relates to thin film SMA superposed on a continuous, thin substrate. This structure produces an effective micro-dimensioned actuator which can be manufactured in a minimum of process steps. A second embodiment of the invention relates to actuators including a stress compensating layer on a second face of the substrate.

More particularly, in one embodiment the invention relates to a mechanical switch of micro-dimensions comprising a shape memory film integrally superposed onto a first substrate face, and with the entire film being bonded to the substrate. In another embodiment, the mechanical switch further comprises one or more compensating films superposed on the second face of the substrate, the one or more films having substantially the same thermal properties as the SMA but a one or more films do not exhibit the shape memory effect.

BRIEF DESCRIPTION OF THE DRAWINGS

FIGS. 1*a* and 1*b* are schematic drawings of thin film SMA actuators of the invention.

FIGS. 2*a* –2*c* are schematic drawings of multimorphs of the invention.

DETAILED DESCRIPTION OF THE INVENTION

Figure 3B:
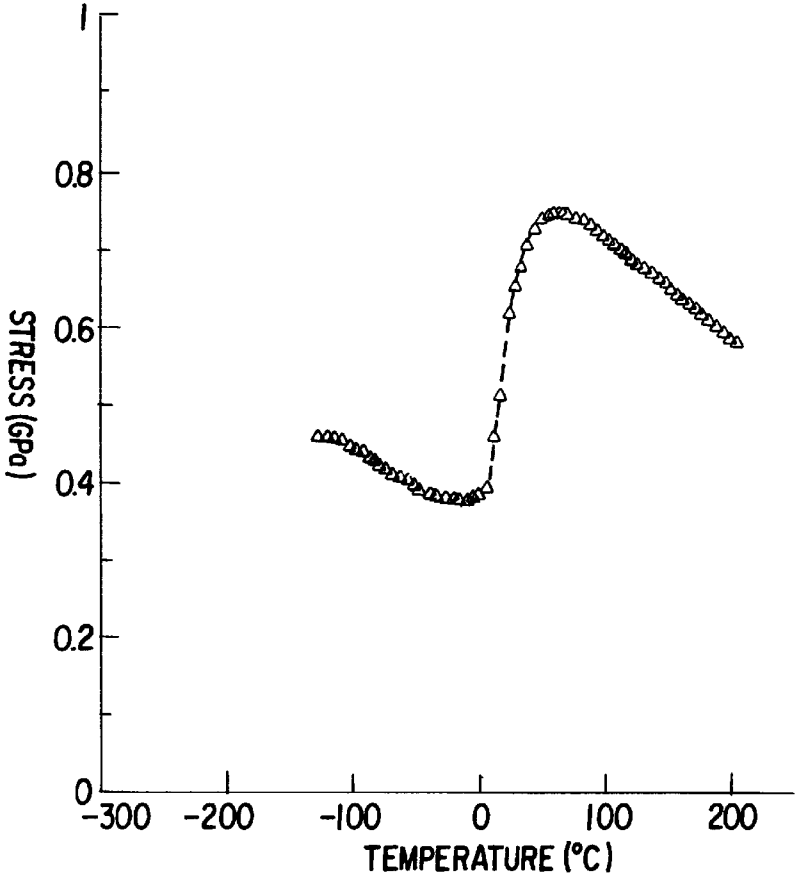
FIGS. 3*a* –3*c* show a plot of stress as function of temperature for the $Ni_{50}Ti_{50}$ multimorphs of FIGS. 2*a* –2*c* , respectively.

The objects of the invention are satisfied by producing an SMA composite 111 (see for instance FIG. 2*a*) used in an actuator 110, as shown in FIGS. 1*a* and 1*b* composed of a thin-film SMA 112, which is the actuator portion and a substrate 114 having good thermal conductivity. Structure 113 is merely a support member. The salient feature of the actuators are thin SMA films deposited on thin substrates. These actuators are further characterized by including therein a multimorph composite 111 wherein the substrate 114 is continuous across the actuator portion of the deposited SMA film. That is, the SMA is deposited in a film in bonded relationship on a face of the substrate so that the film is devoid of any portion which is not bonded with the actuator portion; the SMA and no portion of the face of the substrate, over length of the SMA deposit, remains uncovered. In addition, the substrate is not subjected to, for instance, any processing steps that etches or otherwise removes any portion of the substrate from the as deposited SMA. It is demonstrated herein that no additional processing is required of an SMA/substrate in order to produce a functioning SMA switch. Of course, an uninterrupted substrate as part of an actuator switch will dissipate heat much more quickly from the SMA than an interrupted or etched substrate.

Deposition of the SMA onto the substrate is accomplished preferably by sputter deposition as described in Su et al, *Damping in Multiphase inorganic Materials*. Edited by R. BN. Baghat, ASM International Publication 1993, p165. (Herein incorporated by reference). The as deposited films are amorphous and generally crystallize at 480° C. The films are thereafter treated at 600° C. to facilitate grain growth which establishes well-defined transformation properties.

The composition of the SMA is not critical and may be metallic, a polymeric material or ceramic so long as it exhibits a shape memory effect. A list of metal alloys which will exhibit the shape memory effect include the copper alloy system of Cu—Zn, Cu—Al, Cu—Au, Cu—Sn and ternary alloys formed from these binary alloy systems by adding a third element. Additional alloy systems include Au—Cd, Ni—Al, Fe—Pt, Ti—Pd, In—Ti, Fe—Pd and Mn—Cu. An SMA with exceptional properties is a Ni—Ti, known as NITINOL, which is based on equi-atomic weights of Ti and Ni. The Ni—Ti SMA is an alloy of choice of the present invention.

Substrates used in the actuators of the invention include Si, glass, polymeric material, SiC, and metals such as Al and Cu. A preferred substrate for the SMA alloy is SiC or Si having a thin oxidized layer—a few molecules thick on the surface—to which the SMA is deposited. The oxide surface is created by annealing the substrate. The substrates used in association with the SMA are approximately between 1.0 and 100 microns thick. The substrate film may have a coefficient of expansion greater than the coefficient of expansion of the SMA film.

FIGS. 1*a* and 1*b* illustrate a specific embodiment of the invention wherein a bimorph SMA substrate composite is used as a component of micro-electric circuit breaker 110. A controlled member 118 supported at an end of the composite 111 can be reciprocated from a closed position (FIG. 1*a*) to an open position (FIG. 1*b*) through a selected heating cycle. Heat is obtained by current generated by battery 115. An electrical circuit 117 could thus be controlled and the circuit condition indicated by a means of an external read out device 119. Thus, FIGS. 1*a* and 1*b* illustrate that the SMA deposited on a continuous substrate can function as a micro-actuator of the present invention.

Figure 3A:
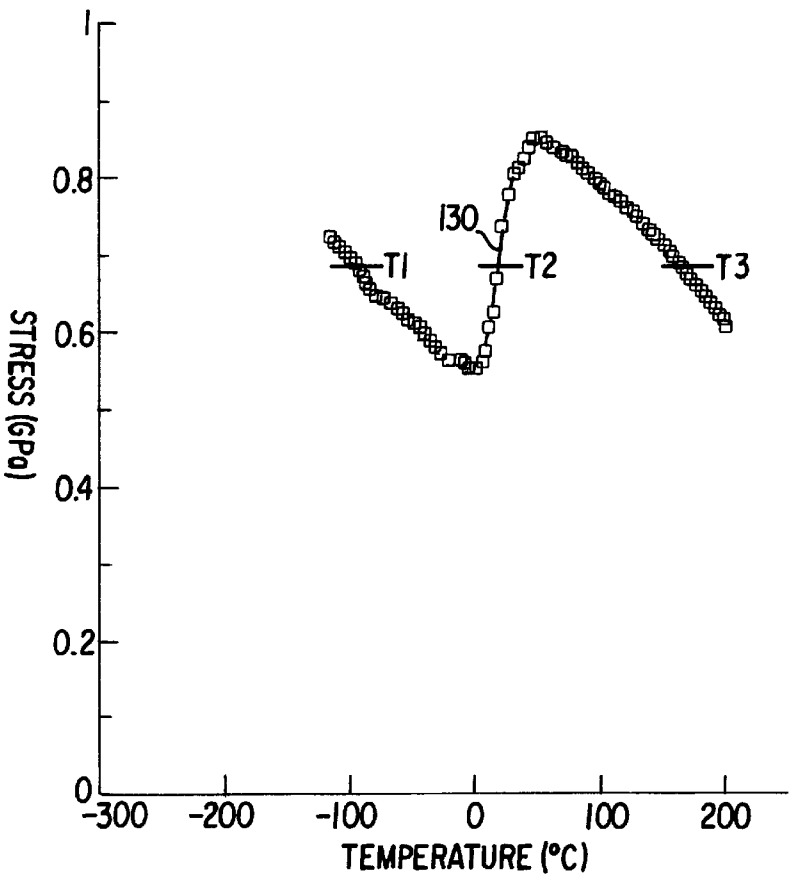
Figure 3C:
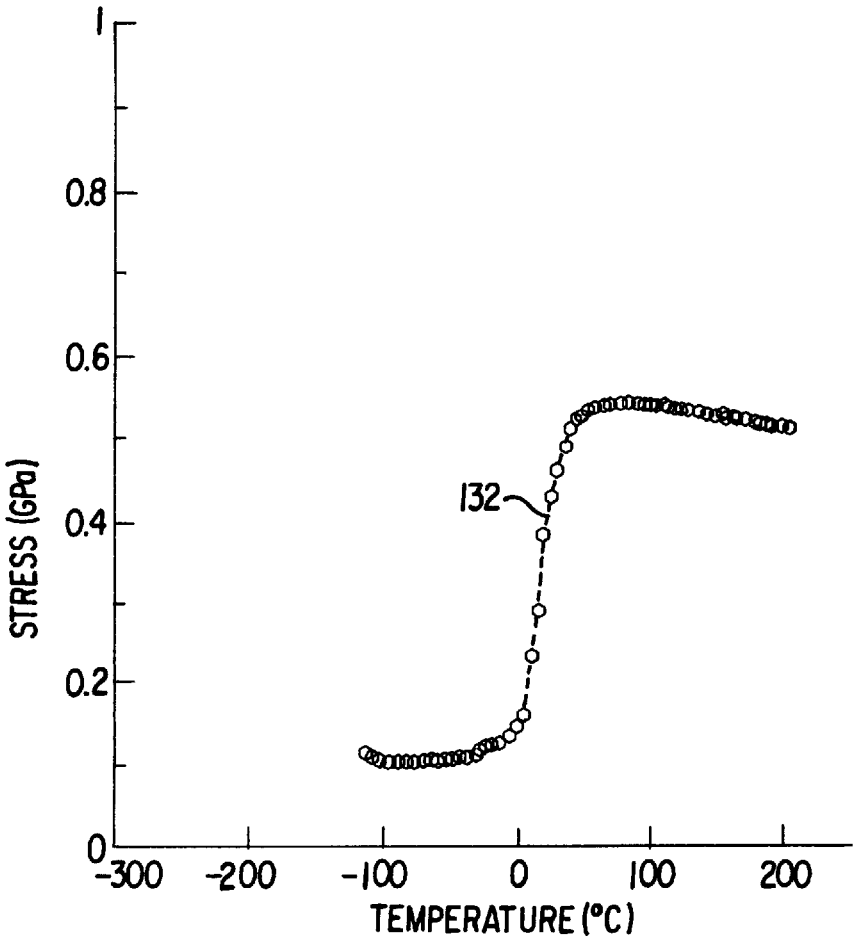

FIGS. 3*a*–3*c* show the typical plots of stress as a function of temperature for the multimorphs of FIGS. 2*a*–2*c* respectively. The multimorphs are composed of at least $Ni_{50}Ti_{50}$ film on a silicon film support. FIG. 2*a* shows a bimorph 111 of NiTi 112 one $\mu$m thick on a silicon substrate 114, which optimally is 90 $\mu$m thick. The stress curve of FIG. 3*a* is generated by heating bimorph 111. Stress is not only produced by the phase change of the deposited SMA but it is also produced by the differences in the coefficient of expansion between the SMA and the substrate. As shown in FIG. 3*a*, over the temperature range, the tension of the bimorph changes. As temperature increases in the region of Ti the tension in the composite 111 decreases because the thermal expansivity of NiTi is greater than that of Si. As the temperature continues to increase transformation from the martensitic to the austenitic phase occurs at curve portion 130 and the volume of the SMA film 112 contracts or shrinks about 0.5% because the SMA film is bonded to the substrate, this contraction creates an increase in the stress in substrate 114 of composite. This volume change can be exploited in that the stress results in the bending of the composite to move control member 118 in the manner shown in FIG. 1*b*. The small change in temperature in the narrow phase change temperature range produces a relatively large SMA volume change. This in turn produces a resulting large displacement of member 118 as compared to that which would be obtained from a differential thermal expansion. As the temperature continues to increase the stress in the composite decreases again due to thermal strains. The shape of the curve of bimorph 111 in FIG. 3*a* is complicated because thermal stress and SMA induced stress during transformation overlap. This complication renders actuation temperature control difficult. In fact FIG. 3*a* illustrates that the bimorph of FIG. 2*a* can have three different actuation temperatures. Points T1, T2, and T3 of FIG. 3*a* identify three actuation temperatures at about 7.0 Gpa.

In view of the above, the inventors found a way to compensate for the thermal stresses of the bimorph 111 by creating a trimorph 140 (FIG. 2*b*) which includes disposing a suitable compensating layer 144 on the side of the substrate 146 opposite of which is the SMA 142. In order to effectively compensate for differences in expansivity between an SMA film and a substrate film making up a micro SMA composite as shown in FIG. 2*a*, and in order to reduce the number of actuation temperatures of such composite the compensating layer 144 (FIG. 2*b*) must be a non-SMA material. However, the compensating layer 144 must possess a thermal coefficient of expansion substantially similar to or equal to the thermal coefficient of the SMA film 142. Non-SMA NiTi (i.e.,non-crystalline NiTi) is an ideal choice as it will, in all respects, have the same physical properties as the SMA layer except for the fact that it will not exhibit a shape memory effect. Compensating layer 144 is 0.5 $\mu$m thick. The fact that this compensating layer reduces stress is evidenced by the flattening of the extreme arms of the stress curve in FIG. 3*b* as compared to the curve in FIG. 3*a*. The plot demonstrates that multiple actuation temperatures can be reduced.

The plot in FIG. 3*c* shows that the phenomenon of multi actuation temperatures can be completely overcome if the compensating layer 154 on the face of the silicon substrate 156 (FIG. 2*c*) has a coefficient of expansion substantially equal to the coefficient of expansion of the SMA layer 152 and it is of the same or substantially the same dimension as the SMA layer. In composite 150, the compensating layer 154 is one $\mu$m thick, which is the same dimension as SMA layer 152. As shown in FIG. 3*c* the multimorph of FIG. 2*c* effectively possesses a unique switching temperature in the curve portion 132.

Without departing from the spirit and scope of this invention, one of ordinary skill in the art can make various changes and modifications to the invention to adapt it to various uses and conditions. For instance it is known that changing the ratio of Ni to Ti in the shape memory alloy will change the transition temperature of the SMA. Thus, SMA's can be fabricated to undergo a phase change at a specific temperature As such, these changes and modifications are properly and equitably intended to be within the fill range of equivalence of the following claims

What is claimed is:

1. A mechanical switch of micro-dimensions comprising a substrate having a face which comprises an actuator portion, said actuator portion comprising a control member which is free to displace between first and second positions, a film of shape memory alloy material deposited in bonded relationship onto the actuator portion of the substrate face, the shape memory alloy material being characterized in contracting in volume by reversibly transforming from martensitic to austenitic crystalline phases responsive to being heated through a phase-change transition temperature, the film being devoid of any portion which is not bonded with the actuator portion to enable said contraction in volume to create a stress in the substrate which causes said displacement of the control member.

2. The mechanical switch of claim 1 further comprising one or more compensating films superposed on a second face of the substrate film, said one or more compensating films having substantially the same thermal properties as the SMA film but said one or more compensating films do not exhibit the shape memory effect.

3. The mechanical switch of claim 1 wherein the SMA film is selected from the group consisting of Cu—Zn, Cu—Al, Cu—Au, Cu—Sn, Au—Cd, Ni—Al, Fe—Pt, Ti—Pd, In—Tl, Fe—Pd, Mn—Cu and Ni—Ti.

4. The mechanical switch of claim 3 wherein the substrate film is selected from the group consisting of Si, glass, polymeric material, SiC, Al and Cu.

5. The mechanical switch of claim 1 wherein the substrate has a film thickness which is between 1 $\mu$m and 100 $\mu$m.

6. The mechanical switch of claim 2 wherein the compensating layer is substantially equal in dimensions to the SMA film.

7. The mechanical switch of claim 6 wherein the SMA film and the compensating film are NiTi.

8. A method for fabricating an SMA actuator comprising: depositing a thin film onto a first face of a thin substrate with the film comprising a shape memory alloy which is characterized in contracting in volume, but not undergoing recoverable shape change, when transforming from a martensitic to austenitic crystalline phase responsive to being heated through a phase change transition temperature, the thin film SMA being disposed on a portion of a substrate face and no portion of the substrate superposed by the deposited SMA film is subjected to a process step that removes a portion of the substrate, so that the SMA film is in contact with the substrate over the entire area of the SMA film.

9. The method of claim 8 further comprising depositing one or more thin compensating films on a second face of the substrate film, said one or more compensating films having substantially the same thermal properties as the SMA but said one or more compensating films do not exhibit the shape memory effect.

10. The method of claim 9 wherein the SMA is NiTi and the compensating layer is NiTi.

11. The method of claim 10 wherein the SMA and compensating layer are equi-dimensioned.

12. A method for reducing the thermal stress in a micro-dimensioned SMA alloy composite composed of at least a shape memory film deposited onto a first face of a substrate film, the method comprising: adding a non-SMA compensating layer to a second face of the substrate film.

13. The method of claim 12 wherein the SMA is NiTi and the compensating layer is NiTi.

14. The method of claim 12 wherein the SMA and compensating layer are equi-dimensioned.

15. A method for actuating a micro SMA composite actuator comprising the steps of providing a substrate having a face together with a film of shape memory alloy material deposited in bonded relationship to an actuator portion of the face, heating the film through the phase change transition temperature of the material, causing the film to contract in volume responsive to phase change of the material from a martensitic crystalline phase to an austenitic crystalline phase, inducing a stress in the substrate responsive to said contraction of the film, and enabling the actuator member to displace responsive to the stress.

* * * * *